United States Patent [19]

Murphy

[11] 4,253,666

[45] Mar. 3, 1981

[54] PERSONAL GOLF SET FOR PAR-3 COURSE

[76] Inventor: William Murphy, Da Cola Shore, Conesus, N.Y. 14435

[21] Appl. No.: 888,171

[22] Filed: Mar. 20, 1978

[51] Int. Cl.[3] ..... A63B 53/02

[52] U.S. Cl. ..... 273/80.1; 273/77 A

[58] Field of Search ..... 273/32 D, 77 R, 77 A, 273/80 R, 80 D, 80.1, 162 R; 224/45 R, 45 L, 45 P, 194, 195, 200, 254, 274, 904, 914, 918-922; 206/315 R; 211/14, 60 G, 60 A; 150/1.5 R, 52 R, 52 G

[56] References Cited

U.S. PATENT DOCUMENTS

| | | | |
|---|---|---|---|
| 1,565,069 | 12/1925 | Edwards | 273/80 R X |
| 2,536,797 | 1/1951 | Cooke | 211/60 A X |
| 2,564,318 | 8/1951 | Wick | 211/60 G X |
| 2,732,871 | 1/1956 | Drown | 150/1.5 R |
| 2,817,472 | 12/1957 | Parkhurst | 224/922 X |
| 3,010,628 | 11/1961 | Kowalczyk | 224/5 C X |
| 3,524,646 | 8/1970 | Wheeler | 273/80 D X |
| 3,819,095 | 6/1974 | Snyder | 224/5 C |
| 3,829,092 | 8/1974 | Arkin | 273/80.1 X |
| 3,848,737 | 11/1974 | Kenon | 273/80.1 X |
| 3,886,962 | 6/1975 | Diamontis | 273/80 D X |
| 3,891,212 | 6/1975 | Hill | 273/80.1 |
| 4,074,739 | 2/1978 | Rodeghier | 211/60 G X |
| 4,164,968 | 8/1979 | Esposito et al. | 150/52 G X |

FOREIGN PATENT DOCUMENTS

| | | | |
|---|---|---|---|
| 2310400 | 9/1974 | Fed. Rep. of Germany | 273/80.1 |
| 1216833 | 11/1959 | France | 224/45 R |
| 16896 | of 1904 | United Kingdom | 273/80.1 |

OTHER PUBLICATIONS

"Good Golf Sales"; Frank Pritchard; Mar. 6, 1947.

*Primary Examiner*—Richard J. Apley
*Attorney, Agent, or Firm*—Raymond F. Kramer

[57] ABSTRACT

A portable golf set for a disassemblable golf club comprising a case adapted for removable attachment to the golfer having means for holding interchangeable heads, tees and golf balls and the parts of the shaft.

8 Claims, 5 Drawing Figures

PERSONAL GOLF SET FOR PAR-3 COURSE

FIELD OF THE INVENTION

This invention relates generally to a wearable case for carrying the interchangeable heads of a golf club, golf balls and tees.

DESCRIPTION OF THE PRIOR ART

The prior art, as exemplified by U.S. Patents 3,424,459; 3,891,212; 1,946,134; 1,253,700; 3,524,646; 3,829,092; 3,848,737; and 3,893,670 is generally illustrative of the pertinent art but the aforementioned patents do not regate patentability of the present invention. While the prior art expedients are generally acceptable for their intended purposes only, they have not proven entirely satisfactory in that they are either complex and expensive to manufacture, or bulky and inconvenient to use, or require unusual skill and/or dexterity to operate. As a result of the shortcomings of the prior art, typified by the above, there has developed a substantial need for improvement in this field.

The principal object of this invention is to provide a device or article of this character which combines simplicity, strength and durability in a high degree, together with inexpensiveness of construction so as to encourage widespread use thereof.

Other objects of this invention will in part be obvious and in part will be hereinafter pointed out.

The invention accordingly comprises features of construction, combinations of elements and arrangements of parts which will be exemplified in the construction hereinafter described, and of which the scope of application will be indicated in the following claims.

SUMMARY OF THE INVENTION

This invention resides in a portable golf set for a disassemblable golf club comprising a case adapted for removable attachment to the golfer having means for holding interchangeable heads, tees and golf balls and the parts of the shaft.

BRIEF DESCRIPTION OF THE DRAWING

In the accompanying drawing, in which is shown one of the various possible illustrative embodiments of this invention, wherein like reference characters identify the same or like parts.

DESCRIPTION OF THE PREFERRED EMBODIMENTS

Figure 5:
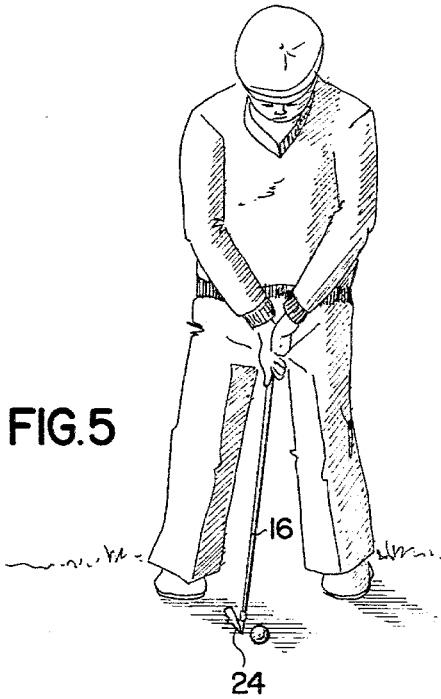
FIG. 5 is a perspective view of the club of the invention in use.
Figure 4:
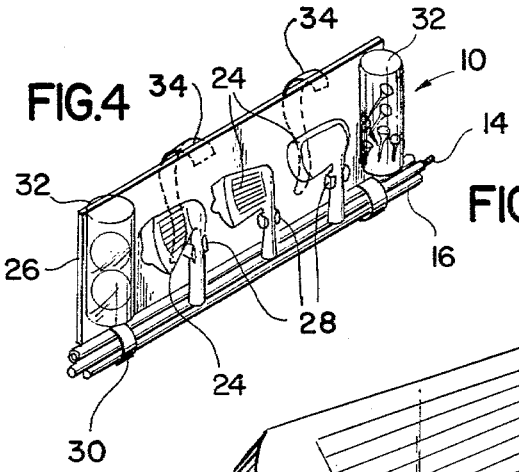
FIG. 4 is an isometric view of the case of the invention showing contents.
Figure 2:
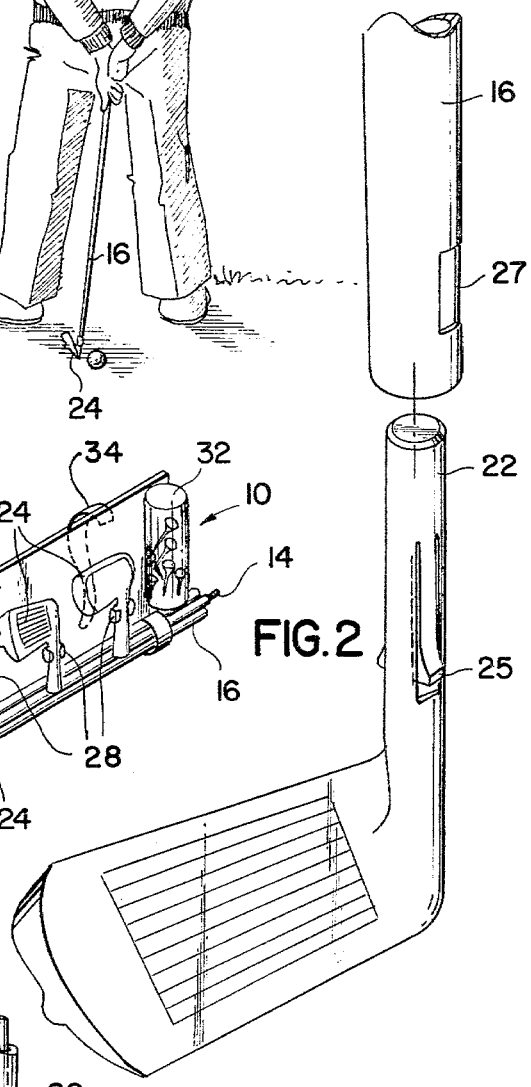
FIG. 2 is a partial elevational view showing engagement of a 9 iron head in the club.
Figure 3:
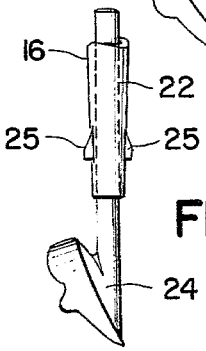
FIG. 3 is a partial side elevation of same.
Figure 1:
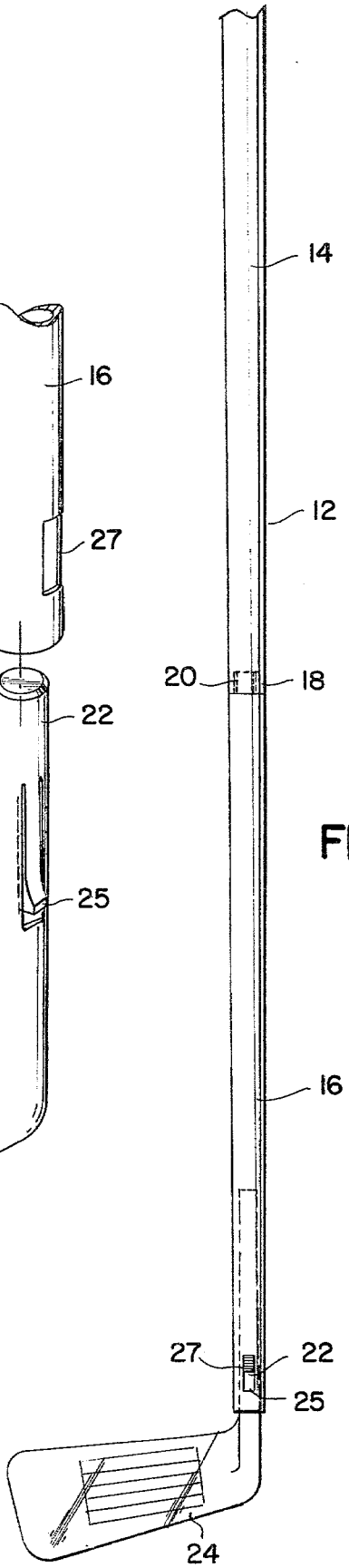
FIG. 1 is a front elevation of the club of the invention.

With reference to the drawing, there is shown and illustrated a demountable golf club and case therefor constructed in accordance with the principles of the invention and designated generally by reference character 10. The illustrated tangible embodiment of the invention includes a metal shaft 12, no longer than 33¼ inches, formed of two sections 14, 16 with section 14 having a threaded opening in its lower end 18 in which is received the threaded upper end 20 of section 16. The lower end of section 16 has a hollow part in which is received the shaft 22 of interchangeable head 24. As shown in FIG. 2, head 24 is a 9 iron. However, head 24 can assume any shape or configuration since it is intended to represent wood, iron and putter heads. In FIG. 1, head 24 thus is a 5 iron. Springs 25 in shaft 22 engage slots 27 in section 16. The parts 14 and 16 of shaft 12 and the three heads 24 are carried in a plastic or canvas case 26 shown in FIG. 4. Case 26 has a plurality of elastic vertical loops 28 in which are held shafts 22 of the interchangeable heads 24. Horizontal loops 30 are also fixed in case 26 which hold sections 14 and 17 of shaft 12. On each end of case 26 are secured containers 32 which hold balls and tees. A pair of resilient 1¾ to 2 inch long plastic clips 34 or other suitable fastenings are secured to case 26 for attaching it to the clothes or belt of a golfer.

The assembly of the invention is particularly designed for a par-3 course. It eliminates the need of a caddy or cart.

The operation and use of the invention hereinabove described will be evident to those skilled in the art to which it relates from a consideration of the foregoing.

The present invention is believed to accomplish among others all of the objects and advantages herein set forth.

Without further analysis, the foregoing will so fully reveal the gist of this invention that those skilled in the art can by applying current knowledge thereto readily adapt it for various applications without omitting certain features which can constitute essential characteristics of the generic or specific aspects of this invention. Therefore, a more lengthy description is deemed unnecessary.

It is intended that various changes may be made in this invention in the practical development thereof, if desired. Such changes are comprehended within the meaning and range of equivalency of the following claims. The invention, therefore, is not to be restricted except as is necessitated by the prior art.

Having thus described the invention, what is claimed as new and to be secured to Letters Patent is:

1. A par-3 golf set comprising in combination, a plurality of shaft parts for assembly into a single golf club shaft selectively useful with any of a plurality of golf club heads, a plurality of golf club heads, selectively assemblable with said shaft to make any of a plurality of different golf clubs, and a carrying case for holding said shaft parts and golf club heads, said carrying case being of canvas or sheet plastic material in a vertical plane in use and extending horizontally, with a pair of clips on a side thereof adapted to hold the case to clothes or belt of a golfer, with resilient means on the other side of the case for individually holding the club heads in spaced apart vertical position and with resilient means at the bottom of the case for holding the plurality of shaft parts in horizontal position, in which position when the shaft parts are held to the case they help to maintain the case in planar shape.

2. A golf set according to claim 1 wherein at the ends of the case there are held, on the same side as the resilient means for holding the club heads, vertical containers for holding golf balls and tees and the case is flexible so that when the shaft parts are not held thereto it may be curved to conform to adjacent body contours when held to the clothes or belt of a golfer.

3. A golf set according to claim 2 wherein the club heads are held in position and apart by the resilient holding means therefor so that they do not make contact with each other when the shaft parts are held in place by the resilient holding means therefor, the vertical containers are transparent cylinders and the clips are of flat plastic.

4. A golf set according to claim 3 wherein there are three clubs, all being irons, which clubs have heads which each include single rods integral therewith, each of which rods includes dual opposed longitudinally positioned bayonet-type spring fasteners adapted to positively lock in place with respect to matching opposed longitudinally extending openings in a lower section of a golf club shaft, and have two sections of a club shaft, the lower section of which is threadedly connectable to the upper section and the lower portion of the lower section of which has in it two opposed longitudinally extending openings into which the spring fasteners of the club heads may be selectively locked to prevent release of the club head except when desired and to prevent turning thereof with respect to the club shaft.

5. A golf set according to claim 4 wherein the clubs are a middle distance iron, a short distance iron and a putter, the club shaft sections are of about equal length, the spring holding means on the club head at rest extends curvingly outwardly from the rod thereof so as to be farther away from the axis of said rod nearer to the club head and has a surface thereof at about a right angle to said rod for contacting a wall of the opening in the lower portion of the lower section of the club shaft to positively hold the club head in position on the shaft for use, which spring portion of the club head is below the resilient holding means for holding such club head to the case when the club head is held to the case.

6. A golf set comprising a plurality of golf clubs, which clubs have heads which each include single rods integral therewith, each of which rods includes dual opposed longitudinally positioned bayonet-type spring fasteners adapted to lock in place positively with respect to matching opposed longitudinally extending openings in a lower section of a golf club shaft, a club shaft in two sections, a lower section and an upper section, the lower section of which is threadedly connectable to the upper section, with the lower portion of the lower section having in it two opposed longitudinally extending openings into which the spring fasteners of the club heads may be selectively locked to prevent release of the club head except when desired and to prevent turning thereof with respect to the club shaft when locked in place, and a carrying case having means for securing it to the clothes or belt of a golfer, resilient holders for said sections of said shaft, resilient holders for the plurality of interchangeable heads, and containers for balls and tees.

7. A golf set according to claim 6 wherein the clubs are a middle distance iron, a short distance iron and a putter, the club shaft sections are of about equal length, the spring holding means on the club head at rest extends curvingly outwardly from the rod thereof so as to be farther away from the axis of said rod nearer to the club head and has a surface thereof at about a right angle to said rod for contacting a wall of the opening in the lower portion of the lower section of the club shaft to positively hold the club head in position on the shaft for use, which spring portion of the club head is below the resilient holding means for holding such club head to the case when the club head is held to the case.

8. A golf set comprising a flexible carrying case having means for securing it to the clothing or a belt of a golfer in extended form conforming to the body of such golfer, said carrying case having means to hold a plurality of golf club heads alongside each other so that they do not touch each other when the case is in extended form but can contact each other when the case is unextended, a plurality of golf club heads held by said case in non-contacting relationship with each other, said heads being selectively attachable to a golf club shaft made of a plurality of shaft parts, said case having means to removably hold a plurality of golf club shaft parts so that when such shaft parts are in held position they rigidify the otherwise flexible carrying case so that the golf club heads, when the case is in extended position, are out of contact with each other, and a plurality of golf club shaft parts held to the case in position when the case is extended, so as to rigidify the case in such position and prevent the held golf club heads from contacting each other, thereby preventing rattling of such heads and marking thereof such as could occur when the heads are held in the case in unextended position.

* * * * *